US009004717B2

(12) United States Patent
Ratkus et al.

(10) Patent No.: US 9,004,717 B2
(45) Date of Patent: Apr. 14, 2015

(54) EXTRUDED HOUSING WITH HINGED LENS FOR LEDS

(71) Applicant: Hafele America Co., Archdale, NC (US)

(72) Inventors: Jeffery Raymond Ratkus, High Point, NC (US); Steven Craig Jones, High Point, NC (US); James Daniel Tripp, Lexington, NC (US); Nina Pavlova Gueorguieva, Jamestown, NC (US)

(73) Assignee: Hafele America Co., Archdale, NC (US)

( * ) Notice: Subject to any disclaimer, the term of this patent is extended or adjusted under 35 U.S.C. 154(b) by 111 days.

(21) Appl. No.: 13/795,491

(22) Filed: Mar. 12, 2013

(65) Prior Publication Data

US 2014/0268736 A1 Sep. 18, 2014

(51) Int. Cl.

| | |
|---|---|
| ***F21V 17/10*** | (2006.01) |
| ***F21S 4/00*** | (2006.01) |
| ***F21V 3/04*** | (2006.01) |
| ***F21V 15/01*** | (2006.01) |
| *F21Y 101/02* | (2006.01) |

(52) U.S. Cl.

CPC ..... *F21S 4/008* (2013.01); *F21V 3/0445* (2013.01); *F21V 15/013* (2013.01); *F21V 17/107* (2013.01); *F21Y 2101/02* (2013.01)

(58) Field of Classification Search

USPC ..... 362/222, 248, 249.19, 374, 240, 647, 362/800, 134, 282, 294, 311.01, 322

See application file for complete search history.

(56) References Cited

U.S. PATENT DOCUMENTS

| | | | | |
|---|---|---|---|---|
| 3,663,990 | A | 5/1972 | Shane | |
| 3,794,830 | A | 2/1974 | Hitzler | |
| 5,816,687 | A | 10/1998 | Tapp | |
| 5,848,837 | A * | 12/1998 | Gustafson | 362/235 |
| 7,980,721 | B2 | 7/2011 | Gray | |
| 2001/0036072 | A1 | 11/2001 | Baker | |
| 2006/0197474 | A1 * | 9/2006 | Olsen | 315/312 |
| 2007/0085361 | A1 | 4/2007 | Hauser | |
| 2011/0255276 | A1 | 10/2011 | Coward | |

OTHER PUBLICATIONS

Web pages advertising Iluminii Recessed Slimline 7, http://www.luminii.com/catalog/linear-led-extrusions/recessedslimline-7.html, known as of Jan. 2, 2013, 2 pgs.

Web pages advertising Solid Apollo Mini 15 Opal Aluminum LED Strip Profile, http://www.solidapollo.com/39.4-mini-15-opal-aluminum-led-strip-profile.html, known as of Jan. 2, 2013, 2 pgs.

* cited by examiner

*Primary Examiner* — Anne Hines

(74) *Attorney, Agent, or Firm* — Womble Carlyle Sandridge & Rice, LLP

(57) ABSTRACT

An extruded housing using a single polymeric material to form an opaque body portion that defines an open channel, a light transmitting lens portion, and a hinge portion joining the body portion to the lens portion to form a unitary body. The hinge portion allows the lens portion to pivot relative to the body portion between an open position, where the channel is open, and a closed position, wherein the lens closes the open channel. The extruded housing is designed to form part of a light emitting diode light fixture, where the housing accepts a strip or plurality of LEDs within the channel for emission of light through the lens portion.

19 Claims, 5 Drawing Sheets

EXTRUDED HOUSING WITH HINGED LENS FOR LEDS

FIELD OF INVENTION

This disclosure relates to extruded profiles, particularly extruded profiles for housing strips of light emitting diodes.

BACKGROUND AND SUMMARY

Through the process of extrusion, a vast array of products made from a vast array of materials can be manufactured to have a consistent cross section. To form an extrusion, material is pressed or drawn through a die of a predetermined profile. One material that is commonly extruded is aluminum. The aluminum is heated to approximately 500 degrees centigrade, softening the material. It is then run though the die and allowed to cool. The extrusion process produces an end product that can be cut to any desired length needed for the finished product, including being customized to the customer.

Extruded aluminum profiles have been used to house strips of light emitting diodes. The profiles may be mounted to a desired surface or recessed into channels formed on the mounting substrate. The extruded aluminum profiles form open channels in which the light emitting diode strips are inserted. The aluminum profiles then require a separate lens to be positioned to cover the open end of the profile's channel. Most often, these lenses are slid into the extrusion along the length thereof. The lenses have also been designed to snap into these aluminum extrusions without having to be slid along the length of the aluminum extrusion.

The inventors have determined a number of problems associated with the manufacture of LED fixtures having aluminum extruded profiles fitted with separate lenses. First, the slide-in lenses severely limit the ability to maintain the light fixtures. Most often, the extrusions are cut or selected to be substantially the same length as their supporting surface. As a result, impediments exist, such as the side walls of a cabinet, which would prevent the lens from being removed, without fully disengaging the extruded housing from the support surface.

Second, extruded aluminum does not possess the necessary light transmission properties to act as a lens for the fixture. Therefore alternative materials must be used, often times various polymers. The use of polymer for the lens, while the profile housing is made from aluminum, causes manufacturing issues. The material of the lens and the material of the housing portion have different levels of warp, different degrees of expansion and contraction/shrinkage when the extruded material is cooled. Often, the aluminum extrusion will be sourced to one supplier while the polymer extrusion is sourced to a second supplier. As a result, it can be difficult to provide the lenses and the housings with sufficiently similar dimensional tolerances. Therefore, the lenses will often be of insufficient size to properly couple with the housing. This leads to lenses which are either too large to be properly inserted or too small, having them fall into the channel of the aluminum extrusion. Even if the lens includes a lip portion to prevent falling into the channel, a lens that is too small will be unable to properly engage the inside of the channel.

Third, aluminum is being a more and more expensive material. This is especially true of aluminum products formed outside of the United States, because tariffs have been placed upon the importation of these products.

As a result of these problems, the inventors have created an improved extruded housing for strips of light emitting diodes (LEDs). The improved housing uses a single polymeric material for the entire housing, both a channel portion and a lens portion. The channel and lens portions are preferably formed of high density polyethylene polymer. The channel portion and the lens portion are co-extruded to provide a unitary housing where the lens portion is formed with the trough portion in a hinged relationship. This hinged connection, referred to as a "living hinge," allows the lens to be removably coupled across the open side of the trough, providing selective access to the trough for installation or removable of an LED strip positioned therein. Preferably the co-extrusion of the housing includes a first pigment added to the lens portion to provide a diffusive translucent cover capable of emitting light. Preferably, the co-extrusion of the housing includes a second, different pigment added to the material forming the trough portion to form an opaque region, preferably similar in finish to aluminum.

These and other aspects of the present invention will become apparent to those skilled in the art after a reading of the following description of the preferred embodiments, when considered in conjunction with the drawings. It should be understood that both the foregoing general description and the following detailed description are exemplary and explanatory only and are not restrictive of the invention as claimed.

BRIEF DESCRIPTION OF THE DRAWINGS

The foregoing and still other objects and advantages of the present invention will be more apparent from the following detailed explanation of embodiments of the invention in connection with the accompanying drawings.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
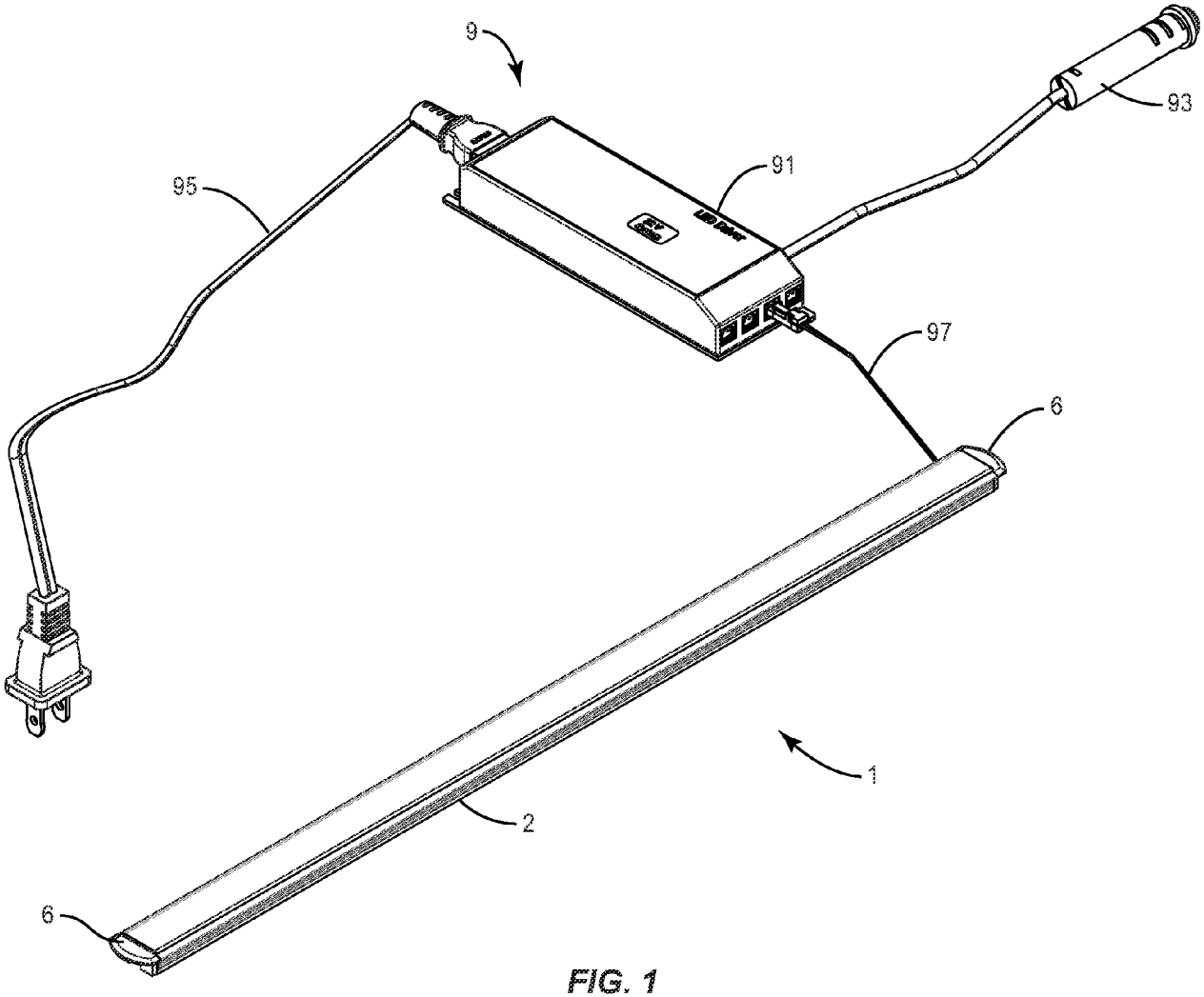
FIG. 1 is a perspective view of a light fixture according to a one aspect of the present disclosure.
Figure 2:
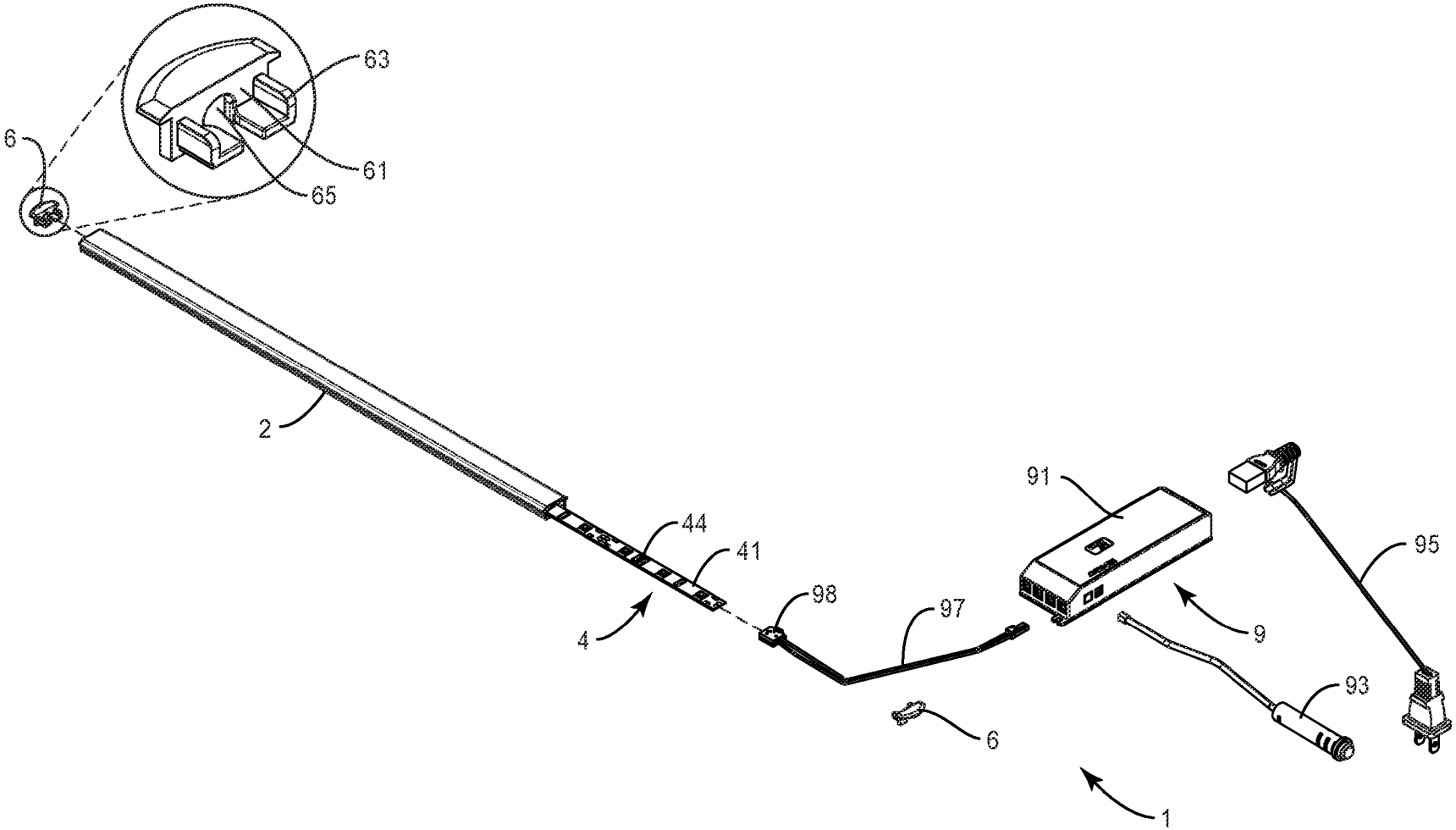
FIG. 2 is an exploded view of the light fixture of FIG. 1.

Turning to FIGS. 1 and 2, a light fixture 1, and exploded view thereof (FIG. 2), having an extruded housing 2 according to this disclosure, is shown. The light fixture 1, includes an extruded housing 2 configured to contain a strip of light emitting diodes (LED) 4. Although LEDs are preferred, alternative emitters of light are contemplated, including organic light emitting diodes (OLED) and electroluminescent (EL) wires or panels. Alternative sources of light within the extruded housing 2 may also include indirect emitters of light such as edge lit light guides or optical fibers.

The LED strip 4 preferably includes a segment of flexible LED ribbon. For example model 3015 LED ribbon available from Hafele America. The flexible LED ribbon of this type includes a flexible substrate 41 with LEDs 44 disposed on one surface of the substrate, and an adhesive disposed on the opposite side of the substrate. The adhesive on the substrate 41 allows the LED strip 4 to be held in place once positioned within the extruded housing 2. The ribbon is formed with predetermined break points disposed between the LEDs so that any length of LED ribbon can be selected and used to form the LED strip 4 of the light fixture 1. The LED strip 4 can include alternative structures resulting in a plurality of LEDs arranged in a linear pattern for placement within the extruded housing 2. For example, a predetermined number of LEDs may be disposed along a predetermined length of a substantially rigid circuit board.

The light fixture 1, further comprises an end cap 6 inserted into each opposite end of the extruded housing 2. The end caps 6 comprise a body 61 forming an end face for the light fixture 1. Extending inwardly from the body 61 is a pair of L-shaped projections 63. The L-shaped projections 63 are configured to form a friction fit with the interior surface of the extruded housing 2. Preferably, at least one of the end caps 6 will include an opening 65. The opening 65 provides access to the interior of the housing for connector cord 97 in order to power the LED strip 4.

As seen in FIGS. 1 and 2, the light fixture 1, may further comprise electrical components 9 in order to operate the LEDs 44 of the LED strip 4. The electrical components 9 may include a driver assembly 91 to provide the LED strip with the necessary voltage and current input. The electrical components 9 may further include a switch 93 to be operated by the user. The switch 93 may be integral with driver assembly 91, may connect to the driver assembly 91 by a wired connection or a remote connection. The electrical components 9 may further include a power cord 95. The power cord 95 attached, integrally or removably, to the driver assembly 91 to provide access to an external power source such as a wall socket. The driver 91 may alternatively receive power from: a battery source, such as lithium or alkaline; a renewable source, such as connected to a photovoltaic cell; or be directly wired to a buildings power supply.

The electrical components 9 will also likely include at least one connector cord 97. The connector cord 97 having at least one electrical connector 98 for connection to the LED strip 4. The connector cord may then be passed through opening 65 in one of the end caps 6 for connection, direct or indirect, integral or removable, with the driver assembly 91.

Figure 3:
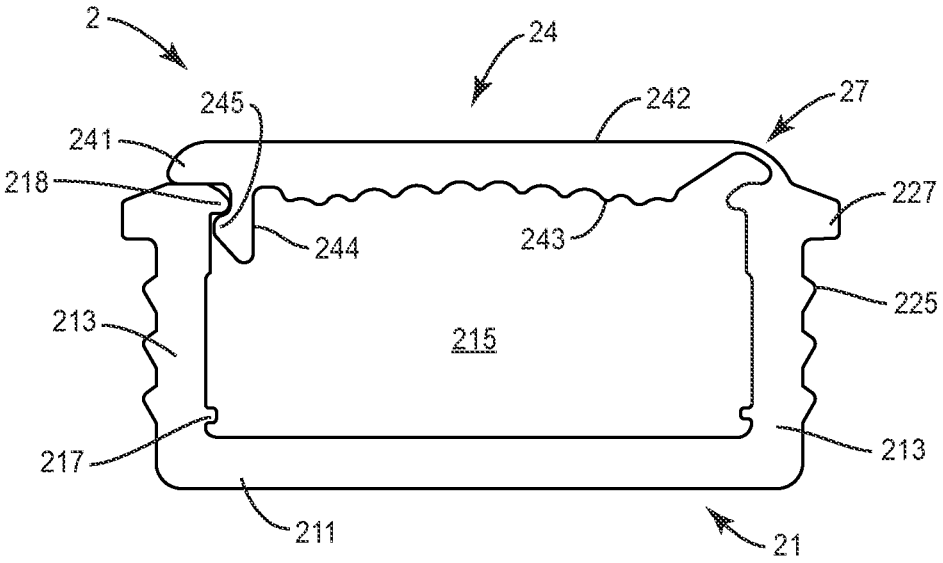
FIG. 3 is a cross sectional view of a first exemplary extruded housing in a closed position.
Figure 4:
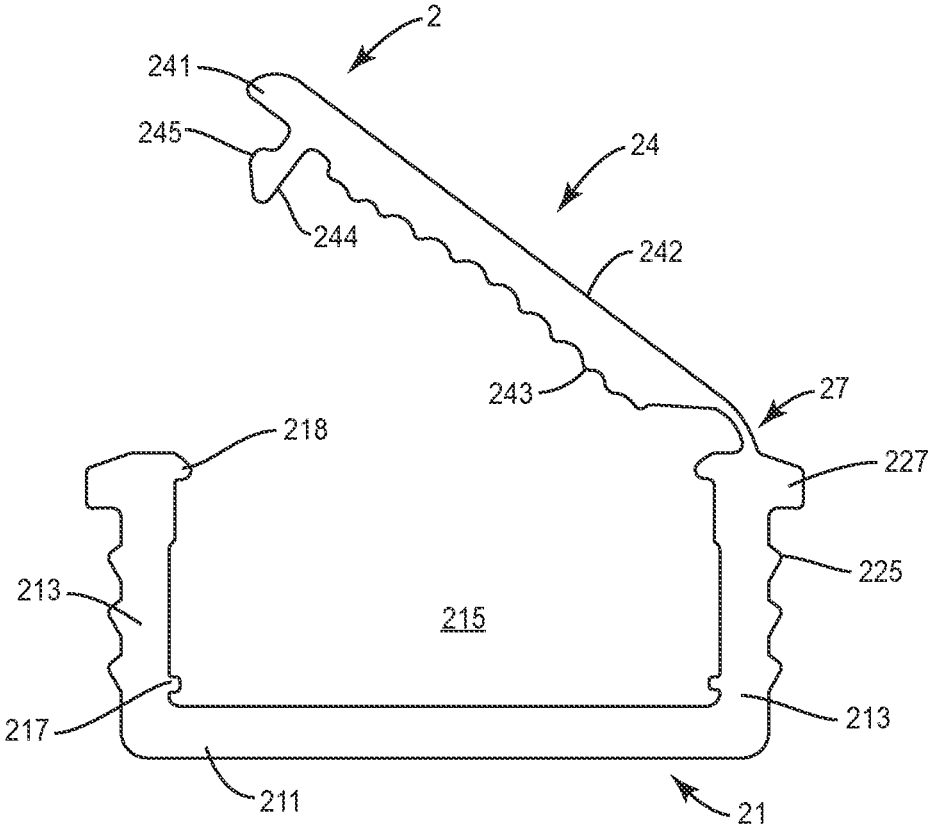
FIG. 4 is a cross sectional view of the first exemplary extruded housing in an open position.

Turning to FIGS. 3 and 4, a cross section of a first exemplary extruded housing 2 is shown. FIG. 3 shows the extruded housing 2 in a closed position, while FIG. 4 shows the extruded housing 2 in an open position. The extruded housing 2 includes a trough portion 21. The trough portion 21 includes a bottom wall 211 and two side walls 213 extending upwardly from the opposite edges of the bottom wall 211 to form a U-shaped channel 215. Each of the walls 211, 213 of the trough portion 21 are substantially the same thickness. Having a substantially similar thickness improves predictability in manufacturing since each wall 211, 213 will cool evenly, minimizing differences in shrinkage and warp. The walls 211, 213 may have a thickness between about 1 mm and about 2 mm, preferably between 1.3 mm and 1.5 mm. The channel 215 should be of sufficient width to accommodate the LED strip 4. The adhesive of the LED strip 4 may be used to attach the LED strip 4 to the bottom wall 211. The channel 215 may have a width of at least about 8 mm and preferably between about 13 mm and about 16 mm. These dimensions will allow the channel 215 to closely enclose the LED strip 4; however other dimensions may be selected based on the type of light emitting units, area, and brightness of light to be emitted from a light fixture 1 using the extruded housing 2. For example, the channel 215 may be formed with sufficient width to accommodate a plurality of side-by-side LED strips 4, thereby increasing the brightness of the assembled fixture 1.

Each of the side walls 213 may include a first projection 217 extending into the channel 215 adjacent to the bottom wall 211. The first projection 217 of each side wall 213 may be capable of being disposed above the substrate 41 of the LED strip 4 and helping maintain the position of the LED strip 4 relative to the housing 2. Each of the side walls 213 can further include second projection 218. The second projection 218 extends inwardly toward the channel 215 from the distal end of each side wall 213, opposite the bottom wall 211.

The extruded housing 2, further comprises a lens portion 24. The lens portion 24 is disposed across the open end of the U-shaped channel 215 of the trough portion 21 and connected thereto along one edge by a living hinge 27. The lens portion 24 is adapted to enclose the extruded housing 2 and transmit light emitted from the light source, such as LED strip 4, disposed within the channel 215. To improve the ease of manufacturing, the lens portion 24 should have a thickness that is reasonably similar to the thickness of the walls 211, 213 of trough portion 21. The lens portion 24 has a width that is wider than the channel 215 so that at least one area 241 of the lens portion 24 abuts the top of at least one of the side walls 213.

Figure 5:
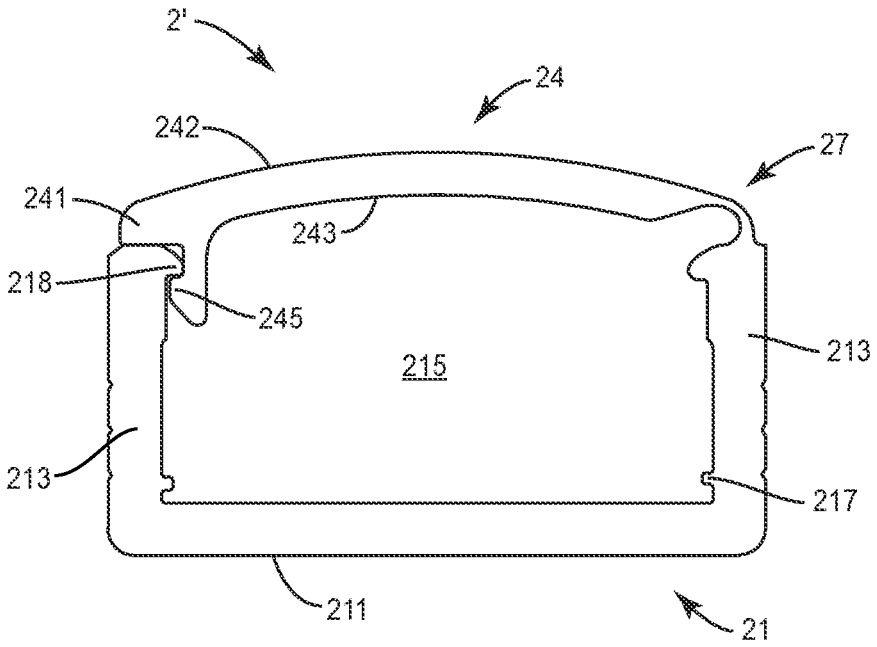
FIG. 5 is a cross sectional view of a second exemplary extruded housing.

The lens portion 24 has an outer surface 242 that may be flat (FIG. 3) or may be convex (FIG. 5). The flat outer surface 242 provides the housing 2 with a lower profile, desired in some applications. The lens portion 24 has an inner surface 243 that may have a generally concave profile. The concaved inner surface 243 may be also be scalloped as shown in FIG. 3. The scalloped nature of the inner surface 243 will help to diffuse light passing though the lens portion 24. Because LEDs 44 are bright points of light, the diffusion of the light will provide a pleasing uniform illumination emitted from the light fixture 1.

The lens portion 24 further includes at least one locking arm 244 extending from the inner surface 243. The locking arm 244 includes a protrusion 245 that extends from an end of the at least one locking arm 244 in an outward direction. The protrusion 245 of the locking arm 244 is configured to engage a lower surface of second projection 218. The at least one locking arm 244 is sufficiently resilient to form a snap fit with the second projection 218, thereby holding the lens portion 24 in place relative to the trough portion 21.

The extruded housing 2 can further include a hinge portion 27. The hinge portion 27 comprises an area of reduced thickness integrally connecting the top distal end of one of the side walls 213 of the trough portion 21 to a distal end of the lens portion 24. The hinged portion 27, commonly called a "living hinge," maintains the connection between the lens 24 and the trough 21, but allows the lens 24 to pivot relative to the trough 21, thereby allowing access to channel 215. Access to the channel 215 is important for maintaining or replacing the LED strip 4 to be disposed within the channel 215. Due to the hinged access, the fixture can be assembled before or after the extruded housing 2 is joined to its support surface. The hinged portion 27 eliminates the need to slide out the lens 24, minimizing the space needed to access the channel 215. The hinged portion 27 also prevents loss of the lens 24 and minimizes the potential for damage to the lens 24 which could occur if the lens 24 were placed apart from the trough 21.

As discussed above, the hinge portion 27 connects one side of the trough 21 to one side of the lens 24. To connect the opposite sides of the trough 21 and lens 24, the at least one locking arm 244 engages with the bottom of the second projection 218.

All elements of the extruded housing 2 are co-extruded using a polymeric material. Preferably, the trough 21, lens 24, and hinge 27 combine to form a unitary polymeric extrusion. While generally, the trough 21, lens 24, and living hinge portion 27 will be preferably formed from the same polymer, it is also possible to use different polymers for the different portions. By using only a single polymer, however, the extrusion process renders much more consistent results, providing a match fit every time. Comparatively, extrusion of a plurality of different materials can result in differences in melting point, warp, shrinkage and the like, all of which hinder the ability to manufacture the housing 2 to consistent specifications.

The extruded housing is preferably made using high density polyethylene (HDPE). Other polymers may also be used, including high temperature ABS, acrylic or polycarbonate. Extruding the housing 2 using a polymeric material also provides an electrical insulator, thereby eliminating the need for a separate insulator between the trough and the light source, used in the prior art aluminum extrusions to prevent the potential for capacitive coupling.

In a preferred embodiment, various pigments will be added to the base polymer during extrusion. A first pigment may be added to the portion of the polymer forming the lens portion 24 or forming the lens portion 24 and the hinge portion 27. The first pigment will provide the respective portions with a milky white, translucent color. The first pigment may be a UV inhibitor. The resulting milky white will provide a pleasing appearance to the light fixture 1 because it will mask the contents of the housing 2 when the light fixture is off, and will diffuse the light from the LEDs 44 when the light fixture is turned on.

In a preferred embodiment, a second pigment may be added to the portion of the polymer forming the trough portion 21. The second pigment will render the trough portion 21 opaque. An opaque trough portion 21 will prevent loss of light through the housing 2 in undesired locations. In one embodiment, the second pigment may be a conventional colorant. Use of a gray colorant will provide the trough portion with a metallic appearance, designed to simulate the aluminum troughs of the prior art.

FIGS. 3 and 4 show a cross section of the first exemplary embodiment of the extruded housing 2 configured to be inlaid with respect to a support surface. In this first embodiment, each of the side walls 213 may include a set of third projections 225 extending from the exterior surface of each wall 213. The third projections 225 are used to increase the friction fit between the housing 2 and a groove in the support surface in which the housing 2 will be inlaid. The extruded housing 2 of this first exemplary embodiment further comprises a flange 227 extending outwardly from the distal ends, opposite the bottom wall 211, of the side walls 213. The flange 227 provides a finished appearance when the housing 2 is inlaid within the support surface, preventing over insertion, and providing a decorative border region of the preferred metallic appearance.

FIG. 5 shows the cross section of an extruded housing 2' according to a second exemplary embodiment of the present disclosure. The extruded housing 2' may be fitted with all of the components of the light fixture 1 found in FIGS. 1 and 2. The extruded housing 2' of this embodiment is intended for use on a support surface without being inlaid into a groove. In order to attach the extruded housing 2' to a support surface, adhesive may be disposed along the bottom of bottom wall 211. The lens portion 24 and hinge portion 27 may combine to form a width similar to equal to the outer dimension of trough portion 21 to minimize the appearance of the trough portion 21 when viewing the fixture from a direction perpendicular to the lens portion 24.

Figure 6:
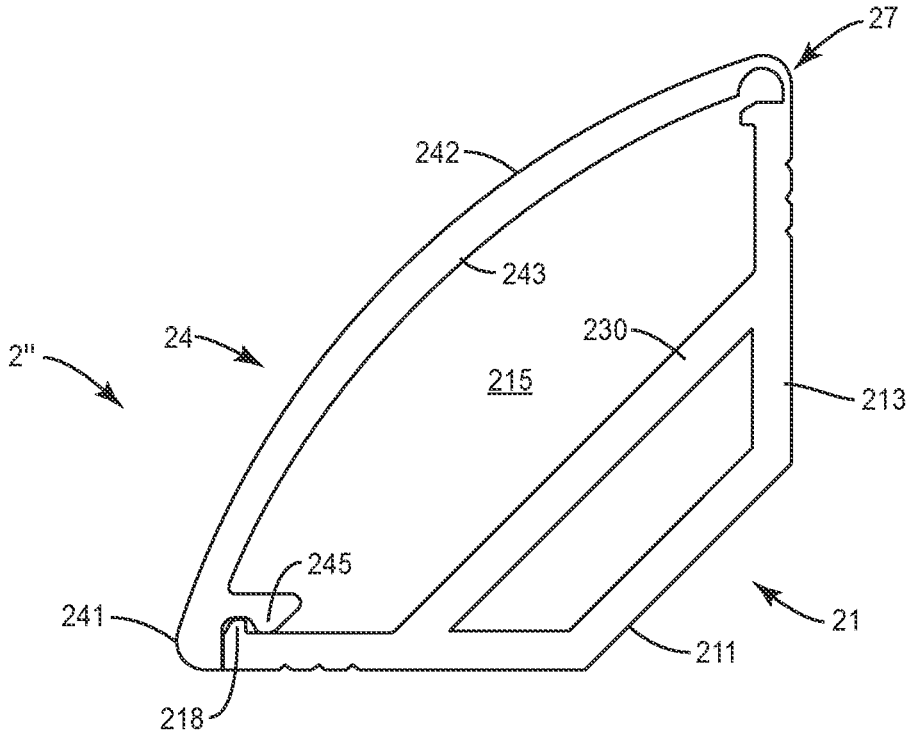
FIG. 6 is a cross sectional view of a third exemplary extruded housing.

FIG. 6 shows the cross section of an extruded housing 2" according to a third exemplary embodiment of the present disclosure. The extruded housing 2" of this third embodiment comprises side walls 213 that extend outwardly from the bottom wall 211 at an oblique angle. Preferably each side wall 213 extends from the bottom wall 211 at an angle of forty-five degrees, thereby forming a right angle between the two side walls 213. This right angle arrangement allows for the extruded housing 2", and any fixture 1 formed therefrom, to be mounted at the interior corner formed by two housing support surfaces. In this embodiment, each of the side walls 213 may have adhesive disposed thereon for attachment to the housing support surfaces. Likewise, the arrangement of the housing 2" results in the bottom wall 211, or an additional LED strip supporting wall 230 disposed parallel thereto, to be angled relative to the housing support surfaces. This provides improved directional lighting into the spaced defined by the housing support surfaces.

Figure 7:
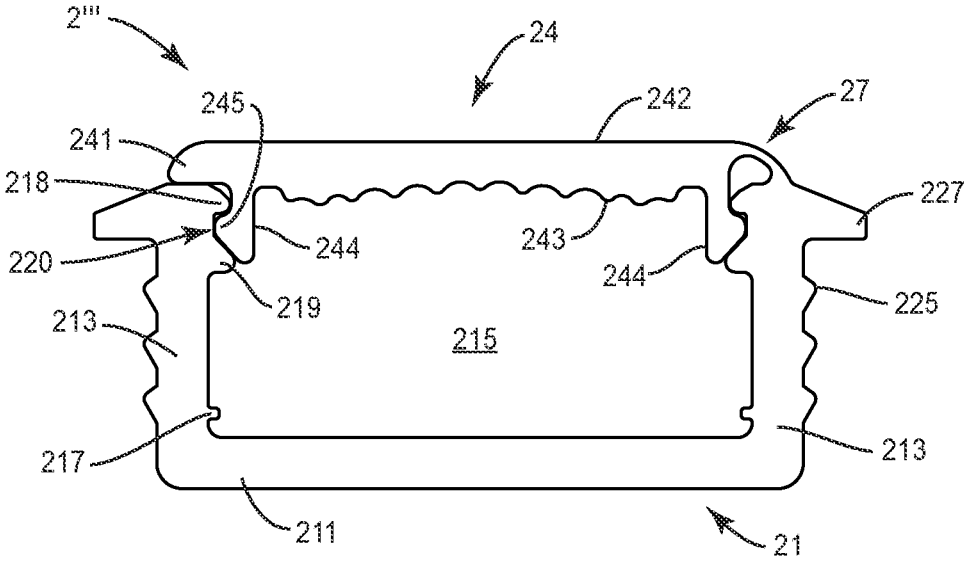
FIG. 7 is a cross sectional view of a fourth exemplary extruded housing.

Referring to FIG. 7, an additional embodiment of the present invention is shown. The extruded housing 2''' is substantially similar to the extruded housing of FIGS. 3 and 4. Extruded housing 2''' is distinct in that each of the side walls 213 include a fourth projection 219 disposed below each second projection 218 to form a recess 220. Further, the lens portion 24 includes an additional locking arm 244 and protrusion 245 on the hinge side of the housing 2'''. The additional locking arm 244 engaging the recess 220 between second projection 218, and the fourth projection 219. Although not shown with additional figures, the elements added to the first housing embodiment 2 to achieve housing 2''' can also be added to housings 2' (FIG. 5) and 2" (FIG. 6).

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. An elongated housing for a fixture containing light emitting units, comprising:

an opaque body portion, the body portion including an elongated, extruded trough so configured as to define a channel with a bottom wall and two side walls, forming an open side, for removably accepting a ribbon of light emitting units;

a light transmitting lens portion, the lens portion being integrally co-extruded with and selectively covering the open side of the channel;

a living hinge portion joining one side wall of the body portion to one side edge of the lens portion to form a unitary body; and the body portion, lens portion, and living hinge portion all co-extruded from the same base polymer, resulting in the housing having a consistent cross-section at all points along the length thereof with respect to shape and material.

2. The elongated housing according to claim 1, wherein the base polymer is high density polyethylene.

3. The elongated housing according to claim 1, wherein the lens portion includes a UV inhibitor added to the base polymer.

4. The elongated housing according to claim 1, wherein the body portion includes pigment added to the base polymer to provide the body portion with a metallic appearance.

5. The elongated housing according to claim 1, wherein at least the side wall of the body portion opposite the side wall to which the lens is hingably attached, includes a protrusion extending inward therefrom and along the length of the side wall, adjacent to the open side of the channel; and the lens portion includes an inner surface and at least one locking arm extending from the inner surface downwardly, and along the length thereof opposite the side of the lens portions attached to the body portion, the locking arm selectively engaging the protrusion to hold the lens portion relative to the body portion.

6. The elongated housing according to claim 5, wherein both side walls of the body portion include a protrusion extending inwardly therefrom adjacent the open side, and the at least one locking arm extending from the inner surface of the lens portion comprises two locking arms, one adjacent to each end of the lens portion to engage the respective protrusion on each side wall.

7. The elongated housing according to claim 1, wherein the lens portion includes an inner surface and an outer surface, the inner surface being scalloped to diffuse light passing therethrough.

8. The elongated housing according to claim 1, the bottom wall and the side walls of the body portion have a substantially similar first thickness; and the lens portion having a minimum of a second thickness, the second thickness being at least one-half the first thickness.

9. The elongated housing according to claim 1, wherein the channel has a first width; and the lens portion has a second width, the second width being larger than the first width such that the lens portion sits primarily atop, and not within, the channel.

10. The elongated housing according to claim 1, wherein the two side walls diverge in a direction away from the bottom wall.

11. A light fixture comprising:

a plurality of light emitting diodes (LEDs) spaced along a substrate to form an elongated LED ribbon;

an LED driver assembly;

an elongated, extruded polymeric housing enveloping the elongated LED ribbon, the housing comprising:

an opaque body portion, the body portion including an elongated, extruded trough so configured to define a channel with a bottom wall and two side walls forming an open side, for removably accepting the LED ribbon;

a light transmitting lens portion, the lens portion being integrally co-extruded with and selectively covering the open side of the channel;

a living hinge portion joining one side wall of the body portion to one side edge of the lens portion to form a unitary body; and the body portion, lens portion, and living hinge portion all co-extruded from the same base polymer, resulting in the housing having a consistent cross-section at all points along the length thereof with respect to shape and material; and a pair of end caps disposed at respective ends of the extruded housing.

12. The light fixture according to claim 11, wherein the base polymer is high density polyethylene.

13. The light fixture according to claim 11, wherein the lens portion includes a UV inhibitor added to the base polymer, and an inner surface of the lens portion is scalloped, to further diffuse light emitted from the light fixture.

14. The light fixture according to claim 11, wherein at least the side wall of the body portion opposite the side wall to which the lens is hingably attached, includes a protrusion extending inward therefrom, adjacent to the open side of the channel; and the lens portion includes an inner surface and at least one locking arm extending from the inner surface thereof adjacent the side of the lens portion opposite the side attached to the body portion, the locking arm engaging the protrusion to hold the lens portion relative to the body portion.

15. The light fixture according to claim 11, the bottom wall and the side walls of the body portion have a substantially similar first thickness; and the lens portion having a minimum of a second thickness, the second thickness being at least one-half the first thickness.

16. The light fixture according to claim 11, wherein the channel has a first width; and the lens portion has a second width, the second width being larger than the first width such that the lens portion sits primarily atop, and not within, the channel.

17. The light fixture according to claim 11, wherein at least one of the pair of end caps include an opening therein, the opening accommodating a wire that connects the plurality of LEDs within the housing to the LED driver assembly disposed outside the housing.

18. The light fixture according to claim 11, wherein the ribbon has an adhesive thereon for attachment to the body portion of the housing.

19. An elongated housing for light emitting diodes, comprising:

an opaque extruded body portion, the body portion defining an elongated channel for removably accepting a ribbon of light emitting diodes, wherein the body portion includes a bottom wall and a pair of side walls extending from the bottom wall and forming an open side; at least one side wall includes at least one protrusion extending from the respective side wall, adjacent to the open side of the channel;

a translucent lens portion, the lens portion being integrally co-extruded with and selectively covering the open side of the channel, wherein the lens portion includes an inner surface and at least one locking arm extending from the inner surface of the lens portion, the locking arm engaging the protrusion on the side wall to hold the lens portion relative to the body portion; and a living hinge portion joining the other side wall of the body portion to the lens portion, opposite the one side wall, to form a unitary body, wherein the body portion, lens portion and living hinge portion are all co-extruded from high density polyethylene, resulting in the housing having a consistent cross-section at all points along the length thereof with respect to shape and material.

* * * * *